US011848525B2

(12) United States Patent
Gerber et al.

(10) Patent No.: US 11,848,525 B2
(45) Date of Patent: Dec. 19, 2023

(54) SINGLE-PAIR ETHERNET DEVICE, SINGLE-PAIR ETHERNET SYSTEM AND METHOD FOR INSTALLING A SINGLE-PAIR ETHERNET SYSTEM

(71) Applicant: Reichle & De-Massari AG, Wetzikon (CH)

(72) Inventors: Matthias Gerber, Rüti (CH); Bernhard Hofer, Effretikon (CH); Marco Zurkirchen, Bubikon (CH)

(73) Assignee: REICHLE & DE-MASSARI AG, Wetzikon (CH)

( * ) Notice: Subject to any disclaimer, the term of this patent is extended or adjusted under 35 U.S.C. 154(b) by 0 days.

(21) Appl. No.: 17/909,643

(22) PCT Filed: Mar. 3, 2021

(86) PCT No.: PCT/EP2021/055345
§ 371 (c)(1),
(2) Date: Sep. 6, 2022

(87) PCT Pub. No.: WO2021/175925
PCT Pub. Date: Sep. 10, 2021

(65) Prior Publication Data

US 2023/0107324 A1 Apr. 6, 2023

(30) Foreign Application Priority Data

Mar. 6, 2020 (DE) ..... 10 2020 106 162.5

(51) Int. Cl.
*H01R 31/00* (2006.01)
*H01R 25/00* (2006.01)
*H01R 31/06* (2006.01)

(52) U.S. Cl.
CPC ..... *H01R 31/005* (2013.01); *H01R 25/003* (2013.01); *H01R 31/06* (2013.01); *H01R 2201/04* (2013.01)

(58) Field of Classification Search
CPC ..... H01R 31/005; H01R 25/003; H01R 2201/04; H01R 31/06
See application file for complete search history.

(56) References Cited

U.S. PATENT DOCUMENTS 8,711,890 B2 * 4/2014 Diab ..... H01R 13/6597 370/546
10,737,133 B2 * 8/2020 Bezemer ..... A63B 23/03508
(Continued)

FOREIGN PATENT DOCUMENTS

WO 2018049314 A1 3/2018
WO WO-2018200528 A1 * 11/2018 ..... H01R 13/502
(Continued)

OTHER PUBLICATIONS

German Office Action and Search report on the Patentability of Application No. DE 10 2020 106 162.5, dated Feb. 4, 2021, 11 pages.
(Continued)

*Primary Examiner* — Briggitte R. Hammond
(74) *Attorney, Agent, or Firm* — Womble Bond Dickinson (US) LLP

(57) ABSTRACT

A single-pair Ethernet device comprises a first input contact and a second input contact, which are configured for electrically contacting a single-pair Ethernet input conductor pair, further comprises a first output contact and a second output contact, which are configured for electrically contacting a single-pair Ethernet output conductor pair, comprises a first conduction path, which in at least one operation state electrically conductively connects the first input contact to the first output contact, and comprises a second
(Continued)

Figure 1:
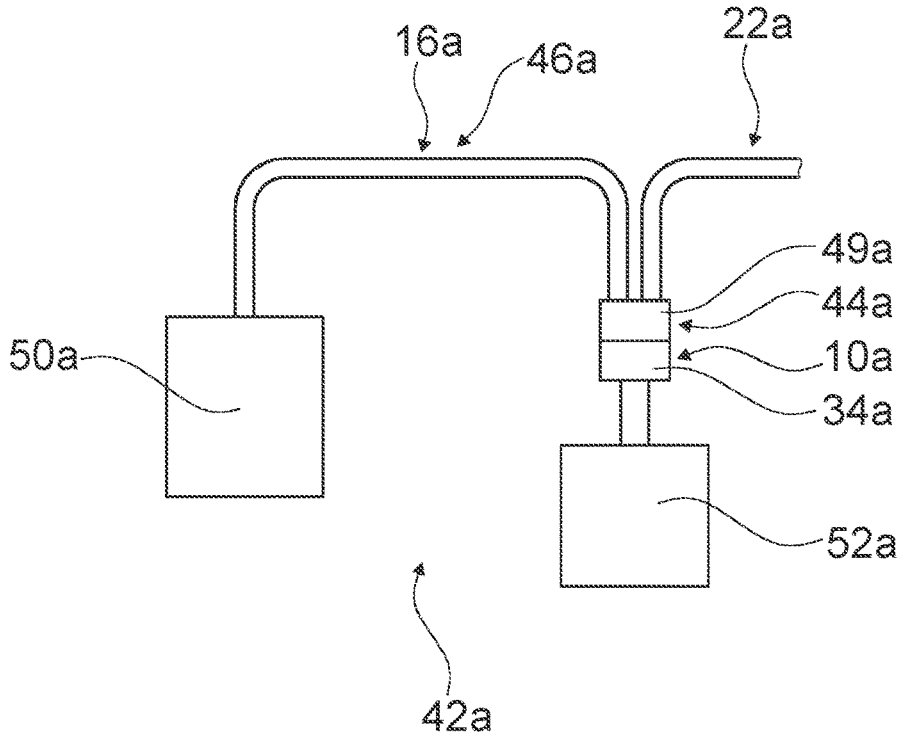

conduction path, which in the operation state electrically conductively connects the second input contact to the second output contact.

18 Claims, 7 Drawing Sheets

(56) References Cited

U.S. PATENT DOCUMENTS

| | | | | |
|---|---|---|---|---|
| 2012/0184131 | A1* | 7/2012 | Andersson | H04L 12/44 439/502 |
| 2018/0323550 | A1* | 11/2018 | Brennan | H01R 13/6594 |
| 2020/0153174 | A1* | 5/2020 | Curtis | H01R 4/184 |
| 2020/0303087 | A1 | 9/2020 | Kennefick | |
| 2020/0393891 | A1 | 12/2020 | Baggett et al. | |
| 2021/0104842 | A1* | 4/2021 | Keith | H01R 13/64 |

FOREIGN PATENT DOCUMENTS

| | | | |
|---|---|---|---|
| WO | 2020051340 | A1 | 3/2020 |
| WO | 2021064008 | A1 | 4/2021 |

OTHER PUBLICATIONS

International Preliminary Report and Written Opinion on the Patentability of Application No. PCT/EP2021/055245, dated Sep. 15, 2022, 14 pages.

* cited by examiner

SINGLE-PAIR ETHERNET DEVICE, SINGLE-PAIR ETHERNET SYSTEM AND METHOD FOR INSTALLING A SINGLE-PAIR ETHERNET SYSTEM

RELATED APPLICATIONS

The present application is the National Phase of International Application No. PCT/EP2021/055345 filed on Mar. 3, 2021, which claims priority to the benefit of German Patent Application no. 10 2020 106 162.5 filed Mar. 6, 2020, and the disclosures of which are hereby incorporated herein by reference in their entireties.

The invention relates to a single-pair Ethernet device, a single-pair Ethernet system, and a method for installing a single-pair Ethernet system.

It is already known from the prior art to form an Internet network by connecting a router to one end of a main line, wherein another end of the main line has a terminating resistor and several T-pieces are arranged on the main line, each of said T-pieces having a stub line leading to an apparatus. This solution has the disadvantages that, due to the terminating resistor, it is not possible to transmit power or data via the Internet network; furthermore, the stub lines must not exceed a length of 30 cm, which severely restricts flexibility with regard to the design of the Internet network. Furthermore, it is not possible to extend the Internet network by simply connecting additional lines.

The object of the invention lies in particular in, but is not limited to, providing a device of the type in question with improved properties with regard to flexibility. According to the invention, the object is achieved, while advantageous embodiments and developments of the invention can be found in the dependent claims.

A single-pair Ethernet device is proposed, which is in particular part of a single-pair Ethernet system, comprising a first input contact and a second input contact, which are configured for electrically contacting a single-pair Ethernet input conductor pair, comprising a first output contact and a second output contact, which are configured for electrically contacting a single-pair Ethernet output conductor pair, comprising a first conduction path, which in at least one operation state electrically conductively connects the first input contact to the first output contact, and comprising a second conduction path, which in the operation state electrically conductively connects the second input contact to the second output contact.

By way of such an embodiment, a flexible embodiment of the single-pair Ethernet system can be achieved. Advantageously, by connecting the single-pair Ethernet input conductor pair to the single-pair Ethernet output conductor pair via the conduction paths, a length of stub lines leading from the single-pair Ethernet conductor pairs to apparatuses can be minimized. Particularly advantageously, a terminating resistor can be omitted, thus allowing simultaneous transmission of power and data through the single-pair Ethernet system. Furthermore, preferably, a customization of the single-pair Ethernet system can be easily achieved by connecting and/or removing single-pair Ethernet devices.

It is conceivable that the single-pair Ethernet device forms the entire single-pair Ethernet system. The single-pair Ethernet system preferably comprises a distributor, in particular a router and/or power distributor, and at least one apparatus. Advantageously, the single-pair Ethernet system has a plurality of connection points, to each of which an apparatus can be connected and/or from each of which an apparatus can be removed. Preferably, the apparatus is part of the single-pair Ethernet device. Preferably, the single-pair Ethernet device is configured to allow connection to a remaining single-pair Ethernet system and/or removal of the apparatus. Particularly preferably, the single-pair Ethernet device forms at least a part of the connection point; it is also conceivable that the single-pair Ethernet device comprises the entire connection point. Alternatively, the single-pair Ethernet device can comprise a shorting plug and can be configured to bridge connection points which are free of connected apparatuses. The distributor is configured to supply data and/or power to the apparatus. Advantageously, the single-pair Ethernet system is part of a smart-home application, wherein the apparatus particularly advantageously comprises a sensor and/or actuator of the smart-home application. It is conceivable that the single-pair Ethernet system is part of a data network, wherein the apparatus could comprise a network chip. Preferably, the single-pair Ethernet system forms a network for supplying apparatuses with data and/or power, said network advantageously being installed in a household, for example, and particularly advantageously enabling any desired removal and connection of apparatuses for supplying the apparatuses, for example by means of common plug-in connections.

Preferably, the single-pair Ethernet system comprises a plurality of single-pair Ethernet input conductor pairs and of single-pair Ethernet output conductor pairs, wherein at least one of the single-pair Ethernet input conductor pairs is electrically conductively connected at one end to the distributor. Advantageously, each apparatus of the single-pair Ethernet system is electrically conductively connected to a single-pair Ethernet input conductor pair, which is arranged in terms of conduction between the corresponding apparatus and the distributor, and a single-pair Ethernet output conductor pair, which is arranged between the apparatus and further apparatuses of the single-pair Ethernet system. Particularly advantageously, the single-pair Ethernet system comprises at least one termination apparatus that is free of electrically conductive connections to a single-pair Ethernet output conductor pair. Preferably, the termination apparatus is convertible into a normal apparatus by simply connecting a single-pair Ethernet output conductor pair to the termination apparatus. Particularly advantageously, the apparatuses are connected in series, wherein in particular the single-pair Ethernet output conductor pair of a first apparatus is identical to the single-pair Ethernet input conductor pair of a second apparatus immediately following the first apparatus. In particular, the distributor is electrically connected to the apparatus via the single-pair Ethernet input conductor pairs and single-pair Ethernet output conductor pairs in the form of a daisy-chain. A "daisy chain" is taken to mean a chain of electrical components, wherein an initial link of the chain, in this case the distributor, is electrically connected to a subsequent link of the chain, in this case the apparatus, via all further links of the chain arranged between the initial link and said subsequent link of the chain, in particular further apparatuses and/or shorting plugs.

The single-pair Ethernet input conductor pair and/or the single-pair Ethernet output conductor pair are/is advantageously each formed as cable cores of a two-core cable, preferably a two-core copper cable. Preferably, the single-pair Ethernet input conductor pair and the single-pair Ethernet output conductor pair are formed identically to each other; alternatively, the single-pair Ethernet input conductor pair and the single-pair Ethernet output conductor pair could be formed differently from each other. Advantageously, the single-pair Ethernet input conductor pair and/or the single-pair Ethernet output conductor pair have/has at one end, in particular at both ends, a chain plug connector, via which the single-pair Ethernet input conductor pair and/or the single-pair Ethernet output conductor pair can be electrically conductively connected to the distributor and/or the apparatus and/or the shorting plug, in particular to form the daisy chain. Preferably, the chain plug connector has four pins, which are electrically conductively connected in pairs to one core each of the single-pair Ethernet input conductor pair or the single-pair Ethernet output conductor pair. It would also be conceivable for the chain plug connector to have only two pins, which are electrically conductively connected to one core each of the single-pair Ethernet input conductor pair or the single-pair Ethernet output conductor pair.

The input contacts and/or output contacts are advantageously formed as pins of at least one connector. Alternatively, the input contacts and/or output contacts could be formed as open ends of conductor tracks, which could be arranged on a circuit board, for example. In a further alternative embodiment, the input contacts and/or output contacts could be integrally formed with the single-pair Ethernet input conductor pair and/or single-pair Ethernet output conductor pair. The expression "integrally" is to be understood to mean at least connected in an integrally bonded manner, such as by a soldering process, and particularly advantageously formed in one piece. Preferably, the input contacts and/or output contacts are part of a bridge plug connector, via which the apparatus is electrically conductively connected to a remaining single-pair Ethernet system. Alternatively, the input contacts and/or the output contacts could be part of the shorting plug. Preferably, the bridge plug connector and the apparatus are mounted on a circuit board; alternatively, the bridge plug connector could be formed as an adapter to which a connector can be connected, which is electrically conductively connected to the apparatus.

A "conduction path" is understood to mean a structural unit that provides an electrically conductive connection between two points. For example, the conduction path could be integrally formed with a core of a cable and/or integrally formed with a conductor track of a circuit board and/or integrally formed with a pin of a connector, preferably of the bridge plug connector. Advantageously, the entire conduction path is integrally formed; alternatively, the conduction path could have a plurality of sub-units that are electrically conductively connected at least in the operation state.

The term "configured" shall be understood to mean specifically designed and/or equipped. The fact that an object is configured for a certain function shall be understood to mean that the object fulfills and/or executes this certain function in at least one application and/or operation state.

It is further proposed that the first conduction path has a first forwarding line, in particular a first branch, and the second conduction path has a second forwarding line, in particular a second branch, wherein the forwarding lines are configured for electrical connection to an apparatus. It would be quite conceivable for the conduction paths to have further forwarding lines. The first forwarding line preferably electrically conductively connects a remaining first conduction path and an input line to one another. The second forwarding line preferably electrically connects a remaining second conduction path and an output line to one another. Advantageously, the input line and the output line form a stub line that electrically conductively connects the apparatus to the rest of the single-pair Ethernet system. The stub line could, for example, be formed as conductor tracks of a circuit board, which is electrically conductively connected to the apparatus, and/or as cable cores of a cable, which is electrically conductively connected to the apparatus, and/or as pins of an adapter plug connector, to which a connector, which is electrically conductively connected to the apparatus, can be plugged. In this way, a flexible embodiment of the single-pair Ethernet system can be achieved. Advantageously, the single-pair Ethernet system can be equipped with any number of forwarding lines in order to electrically conductively connect any number of apparatuses to the distributor in the form of a daisy chain, which can have any number of linked chains and/or chain rings.

In an alternative embodiment, the first conduction path could be integrally formed with the single-pair Ethernet input conductor pair and/or the second conduction path could be integrally formed with the single-pair Ethernet output conductor pair. In this alternative embodiment, it would be possible for the input contacts and output contacts to each be formed as sub-regions of the single-pair Ethernet input conductor pair and the single-pair Ethernet output conductor pair. Additionally, in this alternative embodiment, the conduction paths could be integrally formed with pins of the chain plug connector. Preferably, in this alternative embodiment, the first conduction path electrically conductively connects the first input contact, the first output contact, and a first pin of the chain plug connector. Particularly preferably, in this alternative embodiment, the second conduction path electrically conductively connects the second input contact, the second output contact, and a second pin of the chain plug connector. Particularly preferably, in this alternative embodiment, the chain plug connector has two pins.

In addition, it is proposed that the single-pair Ethernet device comprises a circuit board having at least one of the, and preferably both forwarding lines. Preferably, the first conduction path and/or the second conduction path comprises at least one open conductor track end of the circuit board. In particular, the first forwarding line and/or the second forwarding line is formed as a sub-region of conductor tracks of the circuit board. Advantageously, the input contacts and output contacts are formed as pins of the bridge plug connector. Alternatively, the input contacts and the output contacts could be formed as open conductor track ends of the circuit board. It is conceivable that the first conduction path and/or the second conduction path is arranged entirely on the circuit board or in the bridge plug connector. Preferably, the first conduction path and/or the second conduction path extends over a portion of the circuit board and a portion of the bridge plug connector. This may improve the construction of the single-pair Ethernet device. Advantageously, a length of the stub line can be kept small.

In addition, the circuit board could have at least one of the, and preferably both conduction paths. Advantageously, in this embodiment, the pins of the bridge plug connector are identical to open conductor track ends of the circuit board. This can simplify the construction of the single-pair Ethernet device. Advantageously, there is no need for pins of the bridge plug connector that are formed separately from conductor tracks of the circuit board.

In addition, it is proposed that the single-pair Ethernet device has the bridge plug connector which has one of the, and preferably both of the forwarding lines. It is conceivable that the circuit board and the bridge plug connector each have one of the forwarding lines, preferably either the circuit board or the bridge plug connector has both forwarding lines. In an embodiment in which the circuit board and the bridge plug connector each have one of the forwarding lines, preferably the first input contact and/or the first output contact is formed as a pin of the bridge plug connector and the second input contact and/or the second output contact is formed as an open conductor track end of the circuit board. Advantageously, the bridge plug connector has a bridge plug connector housing within which the first forwarding line and/or the second forwarding line is arranged. Preferably, the first forwarding line and/or the second forwarding line is formed as a sub-region of conductor tracks of the bridge plug connector. This can improve the construction of the single-pair Ethernet device. Advantageously, a length of stub lines can be kept small.

Preferably, the bridge plug connector has at least one of the, and preferably both conduction paths. This can simplify the construction of the single-pair Ethernet device. Advantageously, the circuit board can be omitted.

In addition, it is proposed that the single-pair Ethernet device comprises an adapter plug connector, in particular the adapter plug connector, which is part of an adapter and to which the forwarding lines are electrically conductively connected. An "adapter" is to be understood to mean an electrical component which has a first connector, in particular the bridge plug connector, and a second connector, in particular the adapter plug connector, wherein a further first connector, in particular the chain plug connector, can be connected to the first connector and a further second connector, in particular a connector which is electrically conductively connected to the apparatus, can be connected to the second connector, and wherein the further first connector and the further second connector differ with respect to a plug-in geometry. It is conceivable that the adapter plug connector could be electrically conductively connected to the circuit board; in particular, pins of the adapter plug connector could be electrically conductively connected to open conductor track ends of the circuit board. Preferably, the bridge plug connector is formed as a separate adapter, wherein the pins of the bridge plug connector are advantageously electrically conductively connected to the pins of the adapter plug connector. Particularly preferably, the bridge plug connector has four pins, which are electrically conductively connected to two pins of the adapter plug connector via the forwarding lines. In this way, a flexible embodiment of the single-pair Ethernet device can be achieved. Advantageously, different adapter plug connectors can be used to connect different types of apparatuses to the rest of the single-pair Ethernet system.

In addition, it is proposed that the single-pair Ethernet device has a cable with two cable cores to which the forwarding lines are electrically conductively connected. It is conceivable that the cable is electrically conductively connected to the circuit board; in particular, the cable cores could be electrically conductively connected to open conductor track ends of the circuit board. Preferably, the bridge plug connector is formed as a separate adapter, wherein cores of the cable are advantageously electrically conductively connected to the pins of the bridge plug connector. Particularly preferably, the bridge plug connector has four pins which are electrically conductively connected to the cable cores via the forwarding lines. It would be possible for the cable cores to be permanently connected to the apparatus in an electrically conductive manner. Preferably, the cable has at least one connector for connection to the apparatus. In this way, a flexible embodiment of the single-pair Ethernet device can be achieved. Advantageously, the cable can be used as an extension cable to electrically conductively connect the apparatus to the rest of the single-pair Ethernet system.

In a further embodiment of the invention, it is proposed that the first conduction path and the second conduction path are each free of, in particular effective, forwarding lines. The expression "effective forwarding lines" shall be understood to mean forwarding lines which electrically conductively connect a remaining conduction path to at least one electrical functional unit, for example the circuit board and/or the adapter plug connector and/or the cable and/or the apparatus. Preferably, the single-pair Ethernet device has a shorting plug which has the input contacts, the output contacts and the forwarding lines and advantageously provides a direct conduction of power and/or data from the first input contact to the first output contact and from the second input contact to the second output contact. In this way, a flexible embodiment of the single-pair Ethernet device can be achieved. Advantageously, single-pair Ethernet input conductor pairs and single-pair Ethernet output conductor pairs can be directly electrically conductively connected to each other. Particularly advantageously, a number of apparatuses of the single-pair Ethernet system can be varied in a simple manner by changing bridge plug connectors and shorting plugs without interrupting the daisy chain.

It is further proposed that in at least one further operation state, in particular the further operation state, different from the operation state, the first conduction path and the second conduction path are interrupted. The fact that the conduction paths are "interrupted" shall be understood to mean that in the further operation state the conduction paths are split into a number of sub-units which are separated from one another in terms of conduction. Advantageously, the conduction paths are split into four sub-units in the further operation state, wherein the sub-units are each electrically conductively connected to one of the input contacts or output contacts. It is conceivable that the single-pair Ethernet device has at least one switching unit, for example a relay, by means of which the single-pair Ethernet device can be transferred to the operation state and/or the further operation state. Advantageously, the single-pair Ethernet conductor pairs in the operation state are directly electrically conductively connected by the conduction paths. Preferably, the operation state is formed as an idle state of the single-pair Ethernet device. Advantageously, the conduction paths each have a pair of spring contacts, wherein in the operation state a first spring contact is electrically conductively connected to a second spring contact of the first conduction path and a first further spring contact is electrically conductively connected to a second further spring contact of the second conduction path. Preferably, the single-pair Ethernet device comprises an interruption connector, which is particularly preferably configured for interrupting the conduction paths when the bridge plug connector is plugged in. Particularly preferably, the input contacts and the output contacts are formed as pins of the interruption connector. Particularly advantageously, the bridge plug connector is plugged into the interruption connector in the further operation state and is arranged between the spring contacts. Advantageously, the bridge plug connector has lateral contact surfaces which make electrically conductive contact with the spring contacts. Particularly advantageously, the bridge plug connector has a further first conduction path and a further second conduction path, wherein the further first conduction path electrically conductively connects the first input contact and the first output contact in the further operation state and the further second conduction path electrically conductively connects the second input contact and the second output contact in the further operation state. In this way, an even more flexible embodiment of the single-pair Ethernet system can be achieved. Advantageously, a "normally closed" shorting plug can be provided, which can be transferred from the operation state to the further operation state, and vice versa, by simply plugging in and unplugging the bridge plug connector. Particularly advantageously, a number of apparatuses of the single-pair Ethernet system can be changed without the need to fit or remove shorting plugs.

Advantageously, the single-pair Ethernet device has a plug connector housing, which in particular can be part of the bridge plug connector and which at least partially encloses the first input contact and the second input contact. It is conceivable that the plug connector housing exclusively encloses the first input contact and the second input contact at least partially, and the single-pair Ethernet device in particular comprises a further plug connector housing which encloses the first output contact and the second output contact at least partially. Preferably, the plug connector housing encloses all input contacts and output contacts at least partially. This may simplify the construction of the single-pair Ethernet device. Advantageously, connecting the apparatus to the rest of the single-pair Ethernet system can be achieved using commercially available simplex plugs or duplex plugs.

A single-pair Ethernet system is also proposed, comprising a single-pair Ethernet input conductor pair, in particular the single-pair Ethernet input conductor pair, comprising a single-pair Ethernet output conductor pair, in particular the single-pair Ethernet output conductor pair, and comprising at least one electrical connection point for contacting a single-pair Ethernet device, in particular the single-pair Ethernet device, wherein the connection point is connected to the single-pair Ethernet input conductor pair and the single-pair Ethernet output conductor pair. By means of this, a flexible embodiment of the single-pair Ethernet system can be achieved. Advantageously, a length of stub lines leading from the connection point to an apparatus connected to a remaining single-pair Ethernet system can be minimized.

Preferably, the connection point is formed as the chain plug connector and the single-pair Ethernet device is formed as the bridge plug connector and/or as the circuit board. Alternatively, the connection point and the single-pair Ethernet device could be formed as, in particular different, sub-regions of single-pair Ethernet conductor pairs. It is conceivable that the single-pair Ethernet system and the single-pair Ethernet device could be formed separately from each other, for example, the single-pair Ethernet device could be formed as a toolkit for customization, for example field assembly, of the single-pair Ethernet system. Advantageously, the single-pair Ethernet system comprises the single-pair Ethernet device. This allows a flexibly configurable single-pair Ethernet system to be provided. Advantageously, a customization of the single-pair Ethernet system, for example a change of a number of apparatuses of the single-pair Ethernet system, can be made by simply plugging in and/or unplugging any number of single-pair Ethernet devices.

A method for installing a single-pair Ethernet system, in particular the single-pair Ethernet system, is further proposed, wherein the single-pair Ethernet system is provided in the form of a daisy chain. In this way, in particular, a flexible and easily customizable installation can be achieved. Advantageously, a modular installation of the single-pair Ethernet system can be achieved.

It is further proposed that a single-pair Ethernet conductor pair is split into an unassembled single-pair Ethernet input conductor pair and an unassembled single-pair Ethernet output conductor pair, and at least one connection point is field-assembled at corresponding ends of the unassembled single-pair Ethernet input conductor pair and the unassembled single-pair Ethernet output conductor pair. Preferably, the single-pair Ethernet conductor pair is cut at one point for splitting into the unassembled single-pair Ethernet input conductor pair and the unassembled single-pair Ethernet output conductor pair. Alternatively, the single-pair Ethernet conductor pair could consist of separate unassembled single-pair Ethernet conductor pair parts, wherein, during the splitting process, the unassembled single-pair Ethernet conductor pair parts are selected for use as the unassembled single-pair Ethernet input conductor pair and as the unassembled single-pair Ethernet output conductor pair. The field assembly of the connection point advantageously comprises techniques known to a person skilled in the art for the assembly of cables, such as soldering and/or crimping and/or insulation-displacement connectors. In particular, this allows a flexible embodiment of the single-pair Ethernet system. Advantageously, the connection point can be positioned at a completely arbitrary point of the single-pair Ethernet conductor pair. Particularly advantageously, the connection point can be individually assembled depending on the field of application.

In a further embodiment of the invention, it is proposed that a pre-assembled single-pair Ethernet input conductor pair and a pre-assembled single-pair Ethernet output conductor pair are provided, and respectively one end of the single-pair Ethernet input conductor pair and one end of the single-pair Ethernet output conductor pair are combined to form a termination point. For example, the single-pair Ethernet input conductor pair and the single-pair Ethernet output conductor pair could each be formed as a single-pair Ethernet conductor pair, at the ends of which a simplex plug is arranged in each case, wherein the formation of the termination point can comprise arranging the ends in close proximity to one another or connecting the ends, preferably to form a common duplex plug. In this way, in particular, a simple installation of the single-pair Ethernet system can be achieved. Advantageously, the single-pair Ethernet system can be installed without the use of tools by simply plugging together individual components of the single-pair Ethernet system.

In this regard, the single-pair Ethernet device, the single-pair Ethernet system, and the method for installing a single-pair Ethernet system are not intended to be limited to the applications and embodiments described above. In particular, the single-pair Ethernet device, the single-pair Ethernet system and also the method for installing a single-pair Ethernet system may have a number of individual elements, components, units and method steps that deviates from a number specified herein in order to satisfy an operating principle described herein.

Further advantages will become clear from the following description of the drawings. Exemplary embodiments of the invention are shown in the drawing. The drawings, the description and the claims contain numerous features in combination. A person skilled in the art will expediently also consider the features individually and combine them to form useful further combinations.

Figure 2:
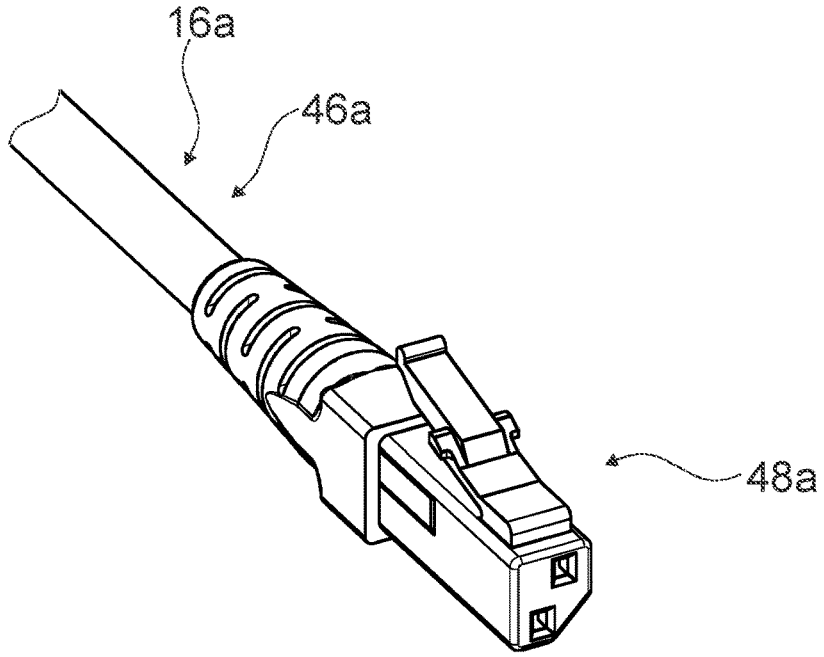
Figure 3:
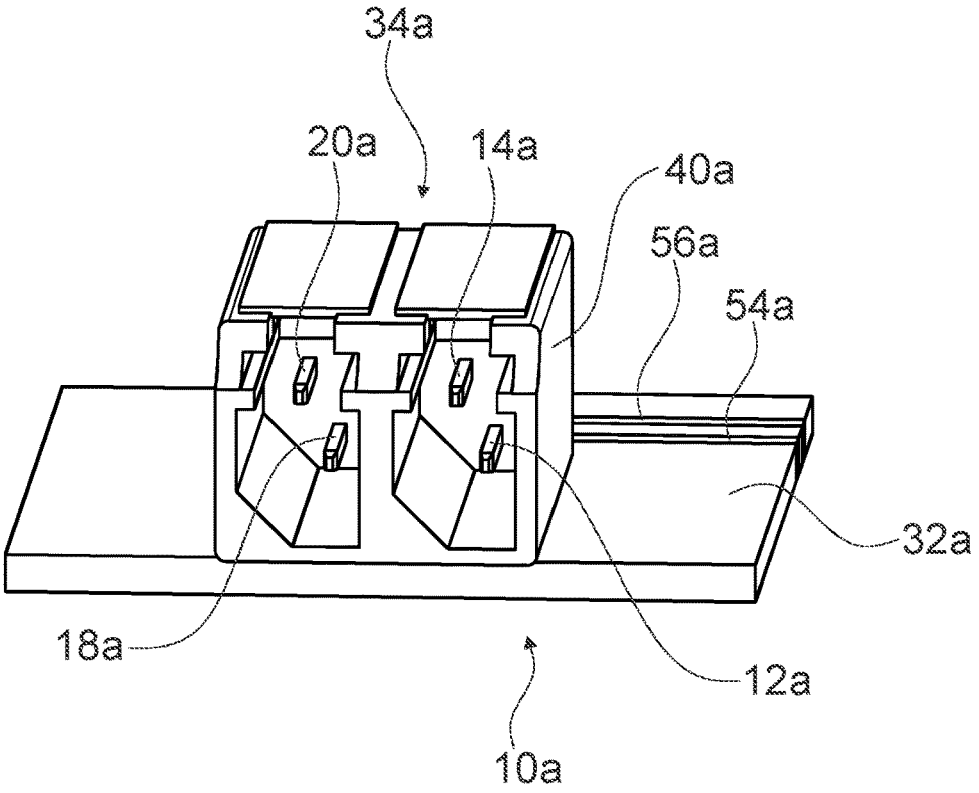
Figure 4:
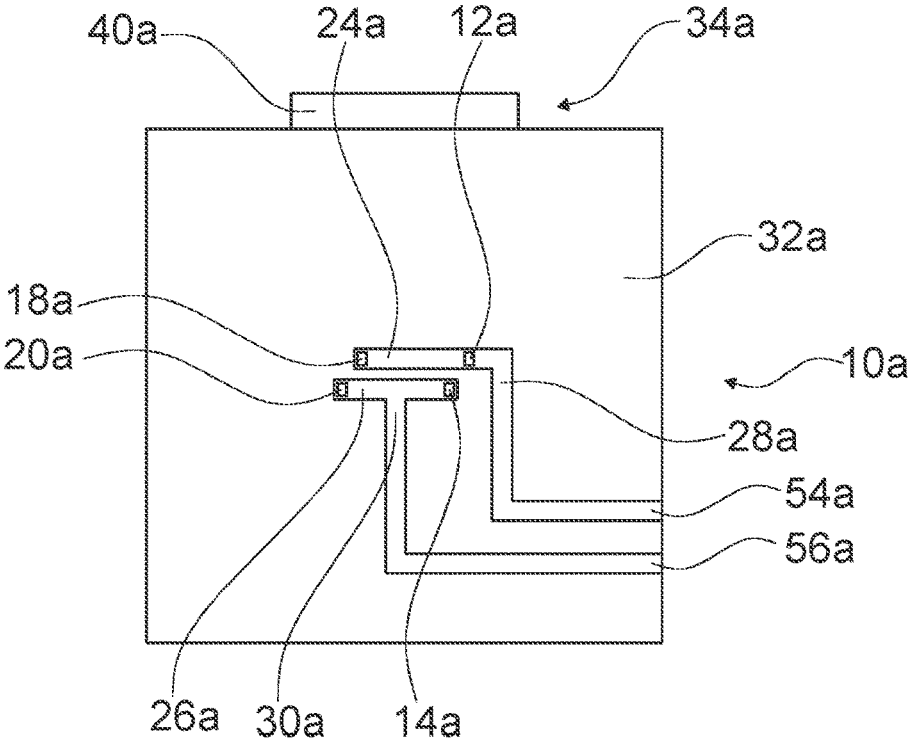
Figure 5:
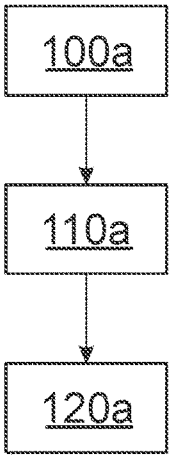
Figure 6:
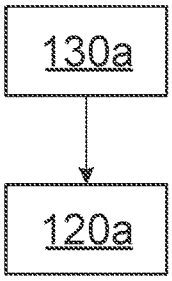
Figure 7:
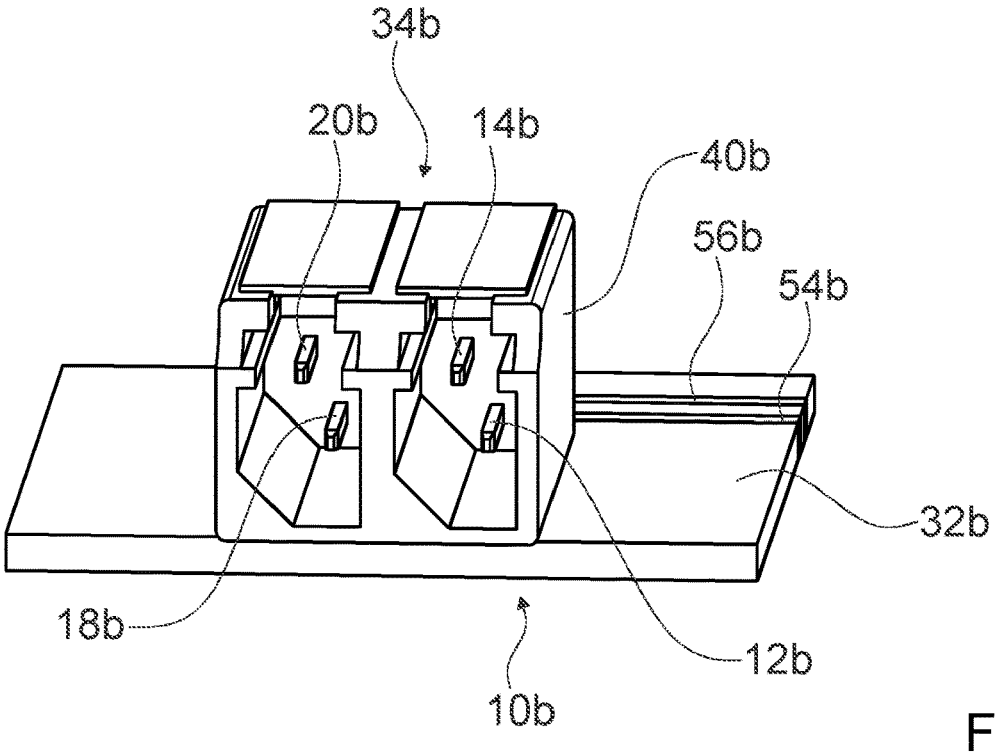
Figure 8:
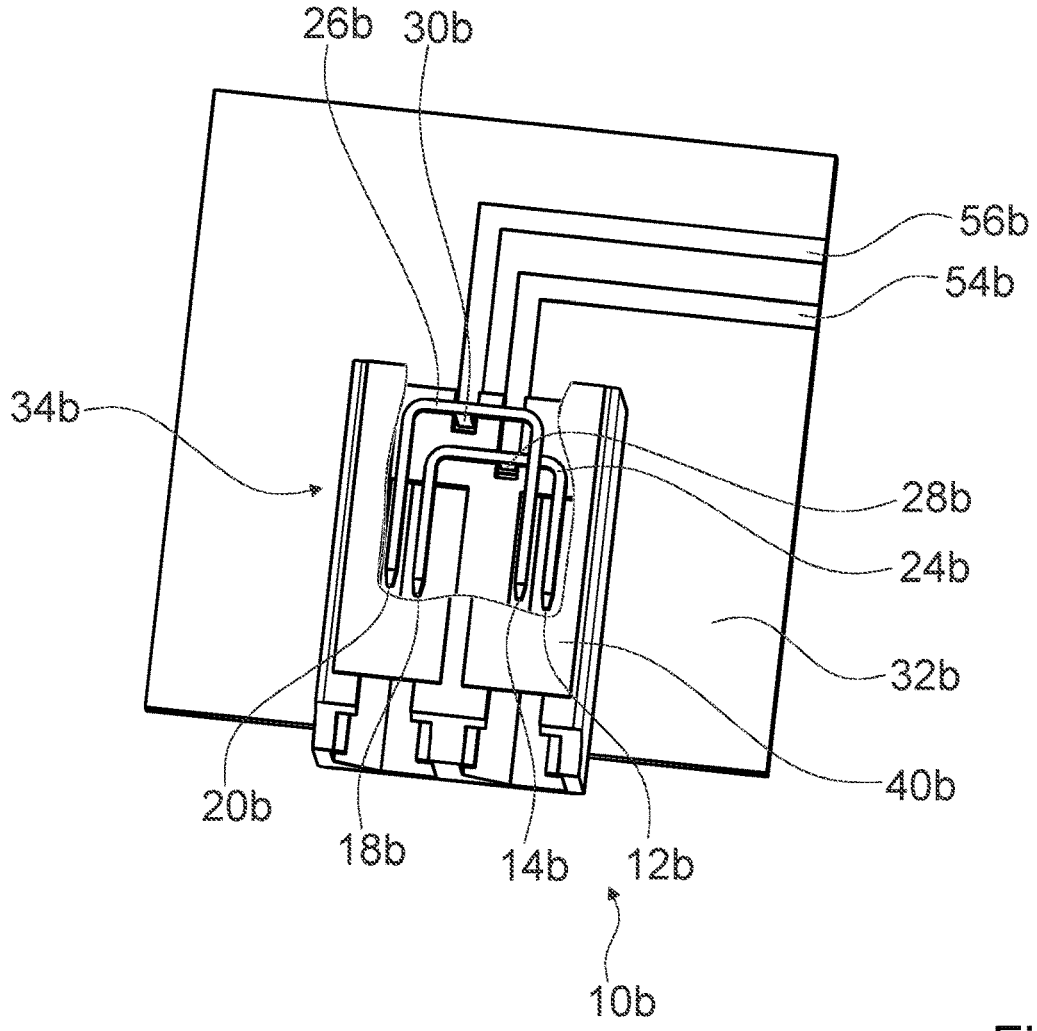
Figure 9:
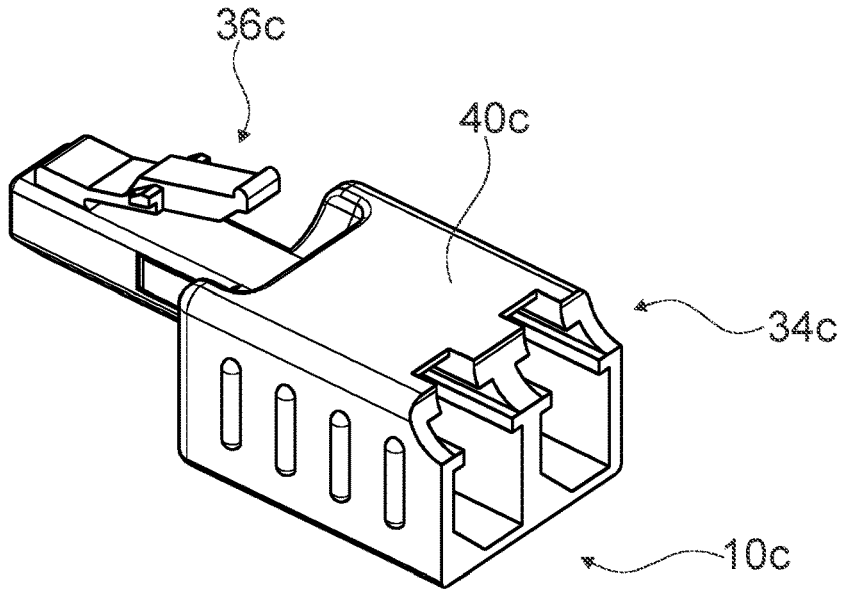
Figure 10:
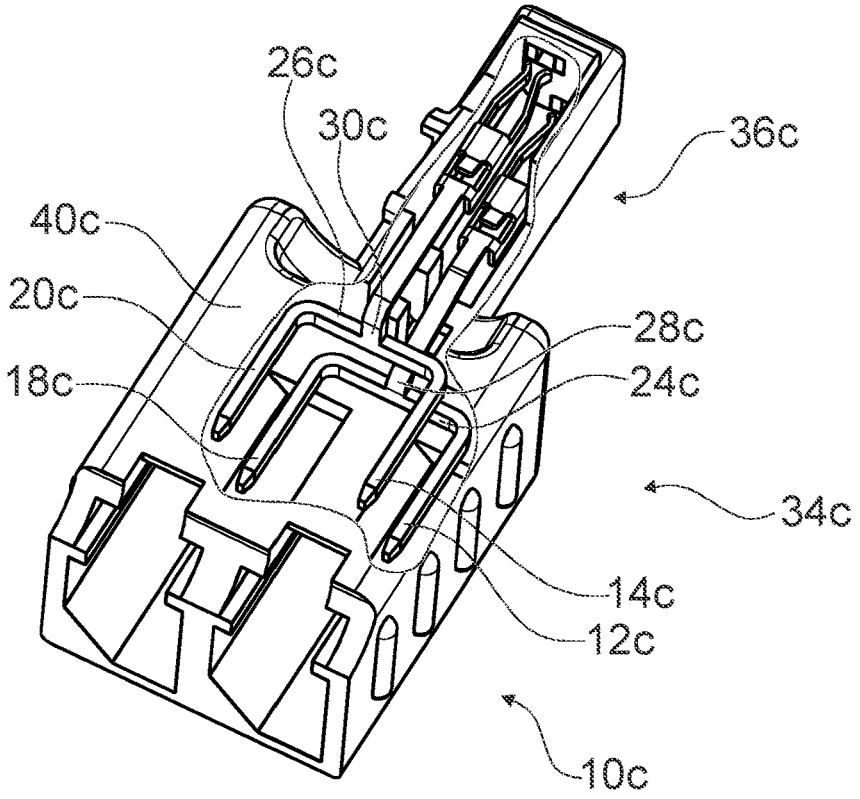
Figure 11:
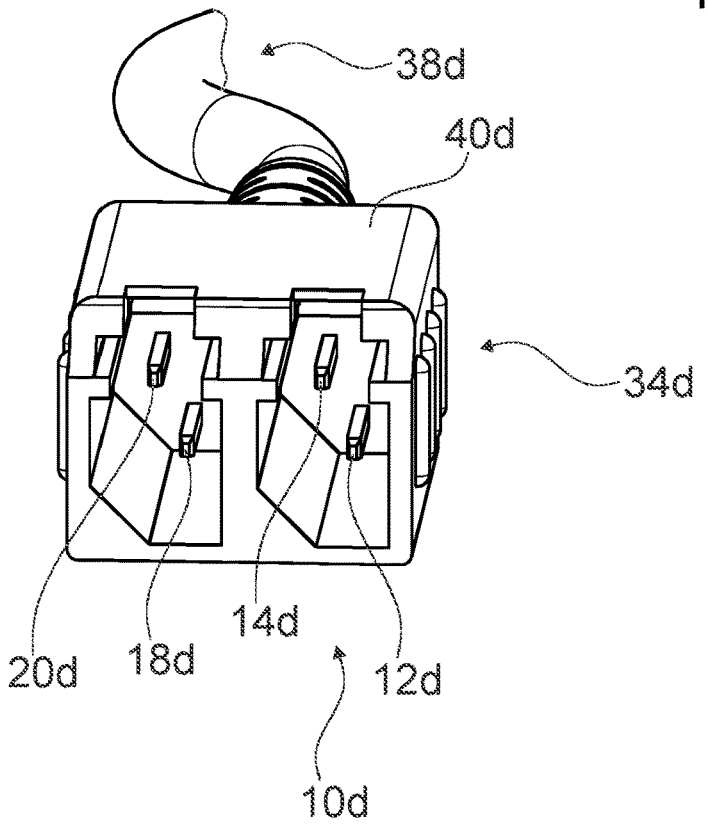
Figure 12:
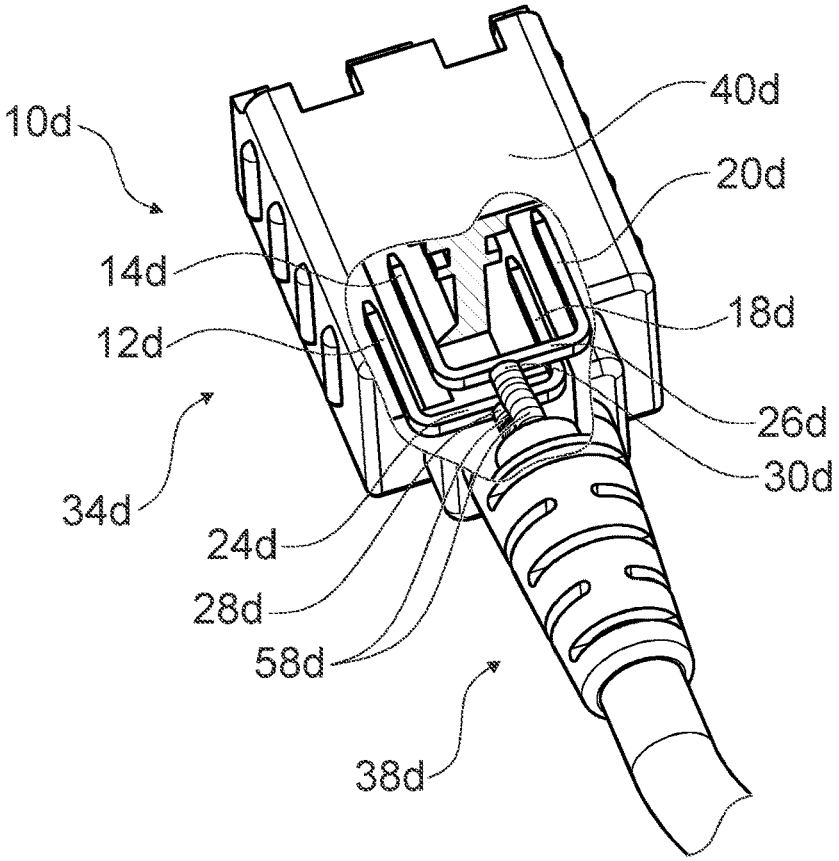
Figure 13:
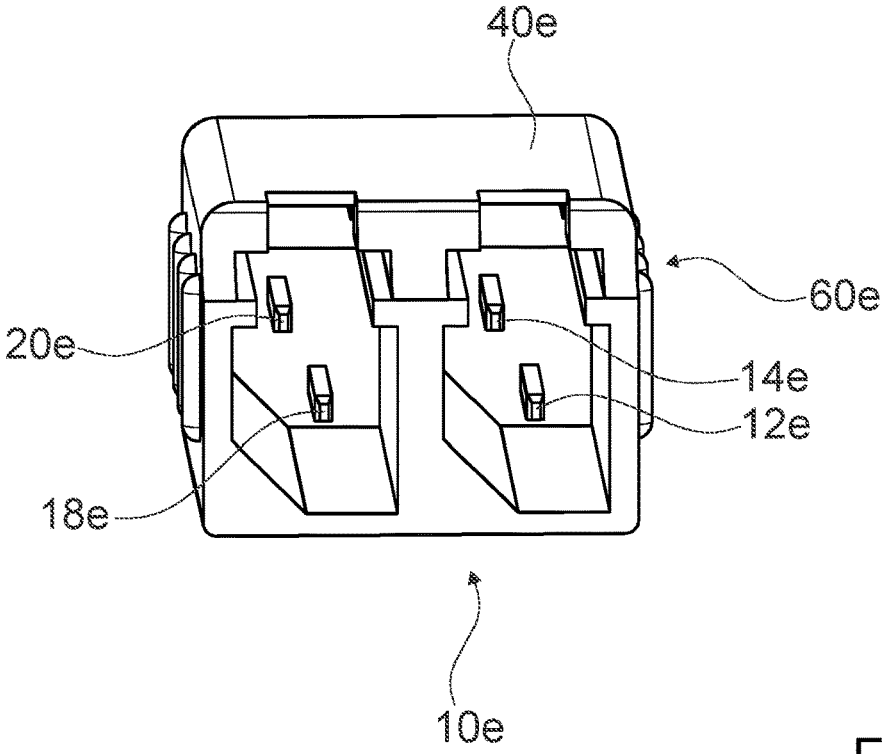
Figure 14:
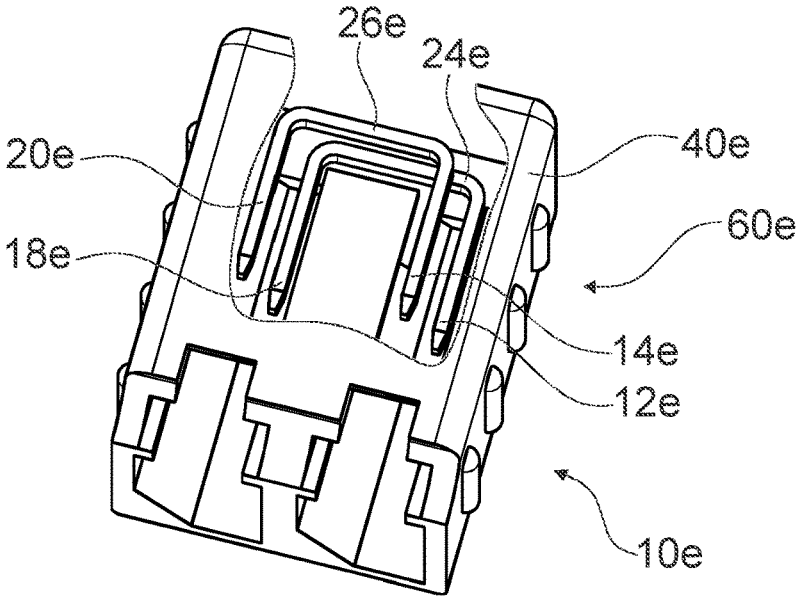
Figure 15:
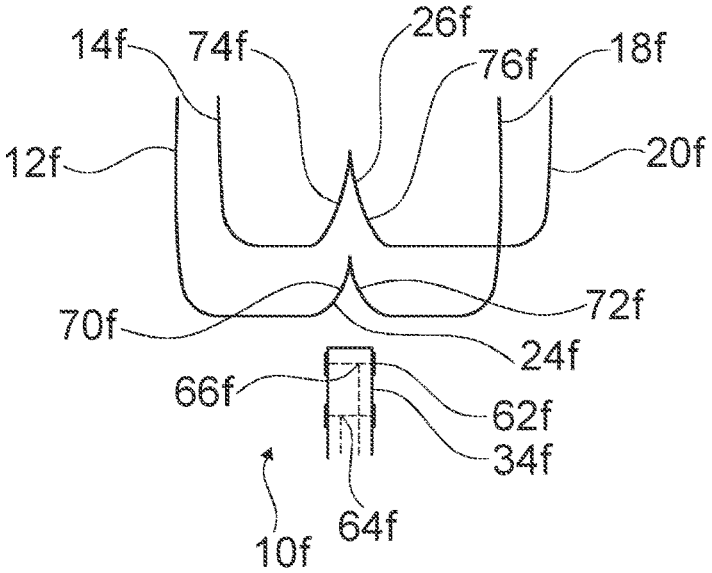
Figure 16:
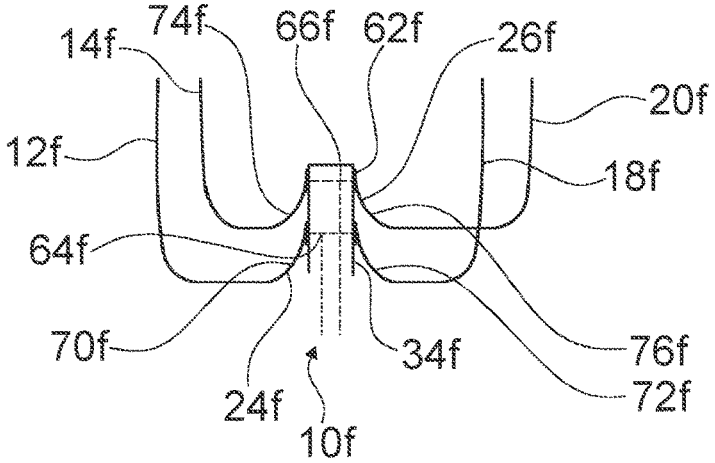

In the drawings:

FIG. 1 shows a schematic representation of a single-pair Ethernet system with a single-pair Ethernet device, FIG. 2 shows part of a chain plug connector of the single-pair Ethernet system in an oblique view, FIG. 3 shows the single-pair Ethernet device in an oblique view, FIG. 4 shows the single-pair Ethernet device of FIG. 3 in a view from beneath, FIG. 5 shows a schematic flow diagram of a method for installing the single-pair Ethernet system, FIG. 6 shows a schematic flow diagram of a further exemplary embodiment of a method for installing the single-pair Ethernet system, FIG. 7 shows a further exemplary embodiment of a single-pair Ethernet device in an oblique view, FIG. 8 shows the single-pair Ethernet device of FIG. 7 in a partially opened view, FIG. 9 shows a further exemplary embodiment of a single-pair Ethernet device in an oblique view, FIG. 10 shows the single-pair Ethernet device of FIG. 9 in a partially opened view, FIG. 11 shows a further exemplary embodiment of a single-pair Ethernet device in an oblique view, FIG. 12 shows the single-pair Ethernet device of FIG. 11 in a partially opened view, FIG. 13 shows a further exemplary embodiment of a single-pair Ethernet device in an oblique view, FIG. 14 shows the single-pair Ethernet device of FIG. 13 in a partially opened view, FIG. 15 shows a schematic representation of a further exemplary embodiment of a single-pair Ethernet device in an operation state, and FIG. 16 shows a schematic representation of the single-pair Ethernet device of FIG. 15 in a further operation state.

In the figures, where objects are shown multiple times, only one of them has been provided with a reference sign.

FIG. 1 shows a part of a single-pair Ethernet system 42*a*. The single-pair Ethernet system 42*a* has a distributor 50*a*. The distributor 50*a* comprises a router. Alternatively or additionally, the distributor 50*a* could comprise a power distributor. The single-pair Ethernet system 42*a* has a plurality of single-pair Ethernet devices 10*a*, only one of which is shown and described below. The single-pair Ethernet device 10*a* has an apparatus 52*a*. The apparatus 52*a* has a sensor of a smart-home application. Alternatively or additionally, the apparatus 52*a* could have an actuator of a smart-home application or a network chip of a computer.

The single-pair Ethernet system 42*a* has a plurality of single-pair Ethernet input conductor pairs 16*a* that are identical to each other, and therefore only one of the single-pair Ethernet input conductor pairs 16*a* is shown in FIG. 1 and only the single-pair Ethernet input conductor pair 16*a* shown is described below. The distributor 50*a* and the apparatus 52*a* are electrically conductively connected in the form of a daisy-chain via the single-pair Ethernet input conductor pair 16*a* and a single-pair Ethernet output conductor pair 22*a*. The single-pair Ethernet system 42*a* has a plurality of single-pair Ethernet output conductor pairs 22*a* that are identical to each other, and therefore only a part of one of the single-pair Ethernet output conductor pairs 22*a* is shown in FIG. 1 and only the single-pair Ethernet output conductor pair 22*a* shown is described below. The single-pair Ethernet input conductor pair 16*a* and the single-pair Ethernet output conductor pair 22*a* are formed identically to each other. Alternatively, the single-pair Ethernet input conductor pair 16*a* and the single-pair Ethernet output conductor pair 22*a* could be formed differently from each other. The single-pair Ethernet input conductor pair 16*a* is formed as part of a single-pair Ethernet cable 46*a* shown in FIG. 2.

The single-pair Ethernet system 42*a* has a plurality of electrical connection points 44*a* that are identical to each other, and therefore only one of the connection points 44*a* is described below. Alternatively, the connection points 44*a* could be formed differently from each other. The connection point 44*a* is used for contacting a single-pair Ethernet device 10*a*, which will be described in more detail later. The connection point 44*a* is connected to the single-pair Ethernet input conductor pair 16*a*. The connection point 44*a* is connected to the single-pair Ethernet output conductor pair 22*a*. The connection point 44*a* is formed from corresponding ends of the single-pair Ethernet conductor pairs 16*a*, 22*a*. The ends of the single-pair Ethernet conductor pairs 16*a*, 22*a* each have a sub-chain plug connector 48*a*, wherein the sub-chain plug connectors 48*a* are formed identically to each other, and therefore only the sub-chain plug connector 48*a* of the single-pair Ethernet input conductor pair 16*a* is described below. The sub-chain plug connector 48*a* of the single-pair Ethernet input conductor pair 16*a* is shown in FIG. 2. The sub-chain plug connector 48*a* is formed as a simplex plug. The sub-chain plug connectors 48*a* together form a chain plug connector 49*a*. The chain plug connector 49*a* is formed as a duplex plug. The chain plug connector 49*a* is formed by connecting both sub-chain plug connectors 48*a*. Alternatively, the chain plug connector 49*a* could be formed as two separate simplex plugs or as one duplex socket or as two separate simplex sockets.

The single-pair Ethernet system 42*a* has a plurality of single-pair Ethernet devices 10*a* that are formed identically to each other, and therefore only one of the single-pair Ethernet devices 10*a* is described below. Alternatively, the single-pair Ethernet device 10*a* could be formed separately from the single-pair Ethernet system 42*a*. The single-pair Ethernet device 10*a* is shown in more detail in FIG. 3. The single-pair Ethernet device 10*a* has a first input contact 12*a*. The single-pair Ethernet device 10*a* has a second input contact 14*a*. The input contacts 12*a*, 14*a* serve to electrically contact the single-pair Ethernet input conductor pair 16*a*. The input contacts 12*a*, 14*a* are formed as pins of a bridge plug connector 34*a*. The single-pair Ethernet device 10*a* has a first output contact 18*a*. The single-pair Ethernet device 10*a* has a second output contact 20*a*. The output contacts 18*a*, 20*a* serve to electrically contact the single-pair Ethernet output conductor pair 22*a*. The output contacts 18*a*, 20*a* are formed as pins of the bridge plug connector 34*a*. The bridge plug connector 34*a* is formed as a duplex socket. Alternatively, the bridge plug connector 34*a* could be formed as two separate simplex sockets or as one duplex plug or as two separate simplex plugs. In the case where the apparatus 52*a* is formed as a termination apparatus, the bridge plug connector 34*a* could also be formed as only a single simplex socket or a single simplex socket.

The single-pair Ethernet device 10*a* has a circuit board 32*a*. The apparatus 52*a* is mounted on the circuit board 32*a* (not shown). The bridge plug connector 34*a* is electrically conductively connected to the circuit board 32*a*. The circuit board 32*a* has a first conductor track 54*a*. The circuit board 32*a* has a second conductor track 56*a*. The conductor tracks 54*a*, 56*a* are electrically conductively connected to the apparatus 52*a*. Alternatively, the conductor tracks 56*a* could be electrically conductively connected to a dual-core cable that is electrically conductively connected to the apparatus 52*a* and/or to a connector that is electrically conductively connected to the apparatus 52*a*. The single-pair Ethernet device 10*a* has a first conduction path 24*a*. The first conduction path 24*a* electrically conductively connects the first input contact 12*a* to the first output contact 18*a*. The single-pair Ethernet device 10*a* has a second conduction path 26*a*. The second conduction path 26*a* electrically conductively connects the second input contact 14*a* to the second output contact 20*a*. The conduction paths 24*a*, 26*a* connect the input contacts 12*a*, 14*a* and the output contacts 18*a*, 20*a* to the conductor tracks 54*a*, 56*a*.

The first conduction path 24*a* has a first forwarding line 28*a*. The second conduction path 26*a* has a second forwarding line 30*a*. The forwarding lines 28*a*, 30*a* are shown in FIG. 4. Alternatively, the conduction paths 24*a*, 26*a* could have any number of further forwarding lines. The forwarding lines 28*a*, 30*a* are formed as sub-regions of the conductor tracks 54*a*, 56*a*. The first forwarding line 28*a* electrically conductively connects a remaining first conduction path to a remaining first conductor track. The second forwarding line 30*a* electrically conductively connects a remaining second conduction path to a remaining second conductor track. The circuit board 32*a* has both forwarding lines 28*a*, 30*a*. Alternatively, the circuit board 32*a* could have only one of the forwarding lines 28*a*, 30*a* or none of the forwarding lines 28*a*, 30*a*. The circuit board 32*a* has both of the conduction paths 24*a*, 26*a*. Alternatively, the circuit board 32*a* could have only one of the conduction paths 24*a*, 26*a* or none of the conduction paths 24*a*, 26*a*.

The single-pair Ethernet device 10*a* has a plug connector housing 40*a*. The plug connector housing 40*a* is part of the bridge plug connector 34*a*. The plug connector housing 40*a* partially encloses each of the input contacts 12*a*, 14*a* and the output contacts 18*a*, 20*a*. Alternatively, the plug connector housing 40*a* could partially enclose only the input contacts 12*a*, 14*a* or only the output contacts 18*a*, 20*a*. The input contacts 12*a*, 14*a* and the output contacts 18*a*, 20*a* each have a sub-region protruding from the plug connector housing 40*a*. The protruding sub-region serve to contact pins of the sub-chain plug connectors 48*a*.

FIG. 5 shows a schematic flow diagram of a method for installing the single-pair Ethernet system 42*a*. The single-pair Ethernet system 42*a* is provided in the form of a daisy chain. In a splitting step 100*a*, a single-pair Ethernet conductor pair (not shown) is split into an unassembled single-pair Ethernet input conductor pair (not shown) and an unassembled single-pair Ethernet output conductor pair (not shown). The splitting step 100*a* comprises cutting the single-pair Ethernet conductor pair at an arbitrary location. In an assembly step 110*a*, the connection points 44*a* are field-assembled at corresponding ends of the unassembled single-pair Ethernet input conductor pair 16*a* and the unassembled single-pair Ethernet output conductor pair 22*a*. The assembly step 110*a* here follows the splitting step 100*a*. The unassembled single-pair Ethernet input conductor pair and the unassembled single-pair Ethernet output conductor pair correspond to the single-pair Ethernet input conductor pair 16*a* and the single-pair Ethernet output conductor pair 22*a* after the assembly step 110*a*. In an interlinking step 120*a*, the apparatus 52*a* is connected to the remainder of the single-pair Ethernet system. The interlinking step 120*a* comprises contacting the single-pair Ethernet device 10*a* through the connection point 44*a*. Here, the interlinking step 120*a* follows the assembly step 110*a*.

FIG. 6 shows a schematic flow diagram of a further method for installing the single-pair Ethernet system 42*a*. The single-pair Ethernet system 42*a* is provided in the form of a daisy chain. In a connection step 130*a*, the single-pair Ethernet input conductor pair 16*a* and the single-pair Ethernet output conductor pair 22*a* are provided. Subsequently, one end of the single-pair Ethernet input conductor pair 16*a* and one end of the single-pair Ethernet output conductor pair 22*a* are combined to form the connection point 44*a*. The connection step 130*a* is followed by the interlinking step 120*a*, analogously to FIG. 6.

FIGS. 7 to 16 show five further exemplary embodiments of the invention. The following descriptions are in essence limited to the differences between the exemplary embodiments, wherein reference can be made to the description of the exemplary embodiment of FIGS. 1 to 6 with respect to components, features and functions which remain the same. To distinguish the exemplary embodiments, the letter a in the reference signs of the exemplary embodiment in FIGS. 1 to 6 has been replaced by the letters b to fin the reference signs of the exemplary embodiments in FIGS. 7 to 16. With regard to identically denoted components, in particular with regard to components with the same reference signs, reference can in principle also be made to the drawings and/or the description of the exemplary embodiment of FIGS. 1 to 6.

FIG. 7 shows a further exemplary embodiment of a single-pair Ethernet device 10*b*. The single-pair Ethernet device 10*b* has a bridge plug connector 34*b*. The bridge plug connector 34*b* has a first forwarding line 28*b*. The bridge plug connector 34*b* has a second forwarding line 30*b*. The forwarding lines 28*b*, 30*b* are shown in more detail in FIG. 8. The bridge plug connector 34*b* has a first conduction path 24*b*. The bridge plug connector 34*b* has a second conduction path 26*b*. The conduction paths 24*b*, 26*b* are formed as T-shaped portions of conductor tracks of the bridge plug connector 34*b*.

FIG. 9 shows a further exemplary embodiment of a single-pair Ethernet device 10*c*. The single-pair Ethernet device 10*c* has a bridge plug connector 34*c*. The single-pair Ethernet device 10*c* is free of circuit boards. The bridge plug connector 34*c* has a first forwarding line 28*c*. The bridge plug connector 34*c* has a second forwarding line 30*c*. The forwarding lines 28*c*, 30*c* are shown in more detail in FIG. 10. The single-pair Ethernet device 10*c* has an adapter plug connector 36*c*. The adapter plug connector 36*c* is formed as a simplex plug. Alternatively, the adapter plug connector 36*c* could be formed as any other type of connector. The forwarding lines 28*c*, 30*c* are electrically conductively connected to the adapter plug connector 36*c*, this being shown in more detail in FIG. 10. The adapter plug connector 36*c* is used to connect a connector which is electrically conductively connected to an apparatus (not shown). Alternatively, the adapter plug connector 36*c* could be used to connect to another single-pair Ethernet conductor pair (not shown) to provide a branch of a daisy chain.

FIG. 11 shows a further exemplary embodiment of a single-pair Ethernet device 10*d*. The single-pair Ethernet device 10*d* has a bridge plug connector 34*d*. The single-pair Ethernet device 10*d* is free of circuit boards. The single-pair Ethernet device 10*d* has a bridge plug connector 34*d*. The bridge plug connector 34*d* has a first forwarding line 28*d*. The bridge plug connector 34*d* has a second forwarding line 30*d*. The forwarding lines 28*d*, 30*d* are shown in more detail in FIG. 12. The single-pair Ethernet device 10*d* has a cable 38*d*. The cable 38*d* has two cable cores 58*d*. The forwarding lines 28*d*, 30*d* are electrically conductively connected to the cable cores 58*d*. The cable 38*d* has an adapter plug connector (not shown) at an end remote from the bridge plug connector 34*d*. The cable 38*d* is electrically conductively connected to an apparatus (not shown). Alternatively, the cable 38*d* could be used to connect to another single-pair of Ethernet conductor pair (not shown) to provide a branch of a daisy chain.

FIG. 13 shows a further exemplary embodiment of a single-pair Ethernet device 10*e*. The single-pair Ethernet device 10*e* has a shorting plug 60*e*. The shorting plug 60*e* has conduction paths 24*e*, 26*e*, which are shown in more detail in FIG. 14. The conduction paths 24*e*, 26*e* are each free of forwarding lines. The conduction paths 24*e*, 26*e* are used for direct electrically conductive connection of input contacts 12*e*, 14*e* and output contacts 18*e*, 20*e* of the shorting plug 60*e*.

FIG. 15 schematically illustrates a further exemplary embodiment of a single-pair Ethernet device 10*f* in an operation state. The single-pair Ethernet device 10*f* is part of a single-pair Ethernet system 42*f*. The single-pair Ethernet device 10*f* has a first conduction path 24*f* and a second conduction path 26*f*. The first conduction path 24*f* electrically conductively connects a first input contact 12*f* and a first output contact 18*f*. The second conduction path 26*f* electrically conductively connects a second input contact 14*f* and a second output contact 20*f*. The input contacts 12*f*, 14*f* and the output contacts 18*f*, 20*f* are formed as pins of an interruption connector (not shown). The interruption connector can be plugged to a chain plug connector of a single-pair Ethernet input conductor pair (not shown) and single-pair Ethernet output conductor pair (not shown). Alternatively, the chain plug connector and the interruption connector could be integrally formed, in particular could be identical to each other. The conduction paths 24*f*, 26*f* each have two spring contacts 70*f*, 72*f*, 74*f*, 76*f*. In the operation state, a first spring contact 70*f* and a second spring contact 72*f* of the first conduction path 24*f* and a first further spring contact 74*f* and a second further spring contact 76*f* of the second conduction path are directly electrically conductively connected. The operation state is formed as an idle state of the single-pair Ethernet device 10*f*. In the operation state, the interruption connector provides a shorting plug function, analogously to the single-pair Ethernet device 10*e* of FIGS. 13 and 14. The single-pair Ethernet system 42*f* has a bridge plug connector 34*f*. The bridge plug connector 34*f* has lateral contact surfaces 62*f*. The contact surfaces 62*f* are electrically conductively connected to an apparatus (not shown). In a further operation state different from the operation state, which is shown schematically in FIG. 16, the first conduction path 24*f* and the second conduction path 26*f* are interrupted. In the further operation state, the bridge plug connector 34*f* is plugged into the interruption connector. In the further operation state, the bridge plug connector 34*f* is disposed between the spring contacts 70*f*, 72*f*, 74*f*, 76*f*. In the further operation state, the input contacts 12*f*, 14*f* and the output contacts 18*f*, 20*f* are electrically conductively connected to the contact surfaces 62*f*. The bridge plug connector 34*f* has a further first conduction path 64*f*. In the further operation state, the further first conduction path 64*f* electrically conductively connects the first input contact 12*f* and the first output contact 18*f*. The bridge plug connector 34*f* has a further second conduction path 66*f*. In the further operation state, the further second conduction path 66*f* electrically conductively connects the second input contact 14*f* and the second output contact 20*f*. In the further operation state, the single-pair Ethernet device 10*f* provides a connection of the apparatus to the single-pair Ethernet input conductor pair 16*f* and the single-pair Ethernet output conductor pair 22*f*.

REFERENCE SIGNS

10 single-pair Ethernet device
12 first input contact
14 second input contact
16 single-pair Ethernet input conductor pair
18 first output contact
20 second output contact
22 single-pair Ethernet output conductor pair
24 first conduction path
26 second conduction path
28 first forwarding line
30 second forwarding line
32 circuit board
34 bridge plug connector
36 adapter plug connector
38 Cable
40 Plug connector housing
42 single-pair Ethernet system
44 electrical connection point
46 single-pair Ethernet cable
48 sub-chain plug connector
49 chain plug connector
50 distributor
52 apparatus
54 first conductor track
56 second conductor track
58 cable core
60 shorting plug
62 contact area
64 first further conduction path
66 second further conduction path
70 first spring contact
72 second spring contact
74 first further spring contact
76 second further spring contact
100 splitting step
110 assembly step
120 interlinking step
130 connection step

The invention claimed is:

1. A single-pair Ethernet device comprising a first input contact and a second input contact, which are configured for electrically contacting a single-pair Ethernet input conductor pair, a first output contact and a second output contact, which are configured for electrically contacting a single-pair Ethernet output conductor pair, a first conduction path, which in at least one operation state electrically conductively connects the first input contact to the first output contact, and a second conduction path, which in the at least one operation state electrically conductively connects the second input contact to the second output contact, wherein the first conduction path comprises a first forwarding line and the second conduction path comprises a second forwarding line, wherein the first and second forwarding lines are configured for electrical connection to an apparatus.

2. The single-pair Ethernet device as claimed in claim 1, comprising a circuit board comprising at least one of the forwarding lines.

3. The single-pair Ethernet device as claimed in claim 2, wherein the circuit board comprises at least one of the conduction paths.

4. The single-pair Ethernet device as claimed in claim 1, comprising a bridge plug connector comprising at least one of the forwarding lines.

5. The single-pair Ethernet device as claimed in claim 4, wherein the bridge plug connector comprises at least one of the conduction paths.

6. The single-pair Ethernet device as claimed in claim 1, comprising an adapter plug connector which is part of an adapter and to which the forwarding lines are electrically conductively connected.

7. The single-pair Ethernet device as claimed in claim 1, comprising a cable having two cable cores to which the forwarding lines are electrically conductively connected.

8. The single-pair Ethernet device as claimed in claim 1, wherein, in at least one further operation state different from the operation state, the first conduction path and the second conduction path are interrupted.

9. The single-pair Ethernet device as claimed in claim 1, comprising a plug connector housing which at least partially encloses the first input contact and the second input contact.

10. A single-pair Ethernet system comprising a single-pair Ethernet input conductor pair, comprising a single-pair Ethernet output conductor pair, and comprising at least one electrical connection point for contacting a single-pair Ethernet device, as claimed in claim 1, wherein the connection point is connected to the single-pair Ethernet input conductor pair and to the single-pair Ethernet output conductor pair.

11. A method for installing a single-pair Ethernet system, as claimed in claim 10, wherein the single-pair Ethernet system is provided in the form of a daisy-chain.

12. The method as claimed in claim 11, wherein a single-pair Ethernet conductor pair is split into an unassembled single-pair Ethernet input conductor pair and an unassembled single-pair Ethernet output conductor pair, and at least one connection point is field-assembled at corresponding ends of the unassembled single-pair Ethernet input conductor pair and of the unassembled single-pair Ethernet output conductor pair.

13. The method as claimed in claim 11, wherein a pre-assembled single-pair Ethernet input conductor pair and a pre-assembled single-pair Ethernet output conductor pair are provided, and respectively one end of the single-pair Ethernet input conductor pair and one end of the single-pair Ethernet output conductor pair are combined to form a connection point.

14. The single-pair Ethernet device as claimed in claim 1, further comprising a plug connector housing which at least partially encloses the first output contact and the second output contact.

15. The single-pair Ethernet device as claimed in claim 1, further comprising a plug connector housing, wherein the first input contact is accessible on a same side of the plug connector housing as the first output contact.

16. The single-pair Ethernet device as claimed in claim 1, further comprising a plug connector housing, wherein the second input contact is accessible on a same side of the plug connector housing as the second output contact.

17. The single-pair Ethernet device as claimed in claim 1, wherein the first conduction path forms a Y-shaped connection.

18. The single-pair Ethernet device as claimed in claim 1, wherein the second conduction path forms a Y-shaped connection.

* * * * *